US007191490B2

(12) United States Patent
Lee et al.

(10) Patent No.: US 7,191,490 B2
(45) Date of Patent: Mar. 20, 2007

(54) SOIL COLLECTION RECEPTACLE ATTACHING/DETACHING APPARATUS FOR CYCLONE VACUUM CLEANER AND VACUUM CLEANER HAVING THE SAME

(75) Inventors: Byung-Jo Lee, Gwangju (KR); Dong-Yun Lee, Gwangju (KR); Min-Jo Choi, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 622 days.

(21) Appl. No.: 10/664,478

(22) Filed: Sep. 18, 2003

(65) Prior Publication Data

US 2004/0231092 A1 Nov. 25, 2004

(30) Foreign Application Priority Data

May 21, 2003 (KR) ..... 10-2003-0032149

(51) Int. Cl.
*A47L 9/10* (2006.01)

(52) U.S. Cl. ..... 15/352; 15/327.6; 55/DIG. 3

(58) Field of Classification Search ..... None
See application file for complete search history.

(56) References Cited

U.S. PATENT DOCUMENTS 6,782,584 B2 * 8/2004 Choi ..... 15/352
6,922,868 B1 * 8/2005 Jeong ..... 15/353

FOREIGN PATENT DOCUMENTS

GB 2384974 A 8/2003

OTHER PUBLICATIONS

Great Britain Search Report Application No. GB 0323016.6, dated Mar. 30, 2004.

* cited by examiner

*Primary Examiner*—David Redding
(74) *Attorney, Agent, or Firm*—Ohlandt, Greeley, Ruggiero & Perle, L.L.P.

(57) ABSTRACT

Disclosed is a soil collection receptacle attaching/detaching apparatus for a cyclone vacuum cleaner, which allows only a soil collection receptacle to be attached to or detached from a cyclone unit that includes a cyclone body as well as the soil collection receptacle, in which the cyclone unit is installed in an accommodation recess provided in a cleaner body, so that the soils in the soil collection receptacle can be conveniently dumped. Also disclosed is a cyclone vacuum cleaner provided with the soil collection receptacle attaching/detaching apparatus. The disclosed inventive apparatus comprises a soil collection receptacle having a sliding groove formed on the bottom surface that confronts the floor of the accommodation recess, a guide member located at the lower end of the soil collection receptacle, wherein the guide member is formed with a pair of guide projections at the opposite sides; and an operation lever adapted to move the guide member up and down, wherein the operation lever comprises a manipulation part and a pair of guide holes that cooperate with the guide projections, wherein the guide member moves up and down as the manipulation part is pulled and pushed, whereby the soil collection receptacle is attached to or detached from the cyclone unit. Because the soil collection receptacle is spaced from the cyclone body as the guide member is lifted, only the soil collection receptacle can be independently separated from the cleaner body.

11 Claims, 6 Drawing Sheets

SOIL COLLECTION RECEPTACLE ATTACHING/DETACHING APPARATUS FOR CYCLONE VACUUM CLEANER AND VACUUM CLEANER HAVING THE SAME

BACKGROUND

1. Field of the Invention

The present invention relates to a vacuum cleaner, and in particular, to a soil collection receptacle attaching/detaching apparatus for a cyclone vacuum cleaner provided with a cyclone unit that renders inhaled air to form swirling air streams, whereby soils are separated from the swirling air streams by centrifugal force, and to a cyclone vacuum cleaner having the soil collection receptacle attaching/detaching apparatus.

2. Description of the Related Art

A typical example of the cyclone vacuum cleaner is illustrated in FIG. 1, which will be briefly described below.

As shown in FIG. 1, the cyclone vacuum cleaner comprises: a cleaner body 10, an accommodation recess 11 provided in the cleaner body 10, and a cyclone unit 20 removably installed in the accommodation recess 11.

A vacuum generation apparatus (not shown) is provided in the inside of the cleaner body 10, and a suction brush 12 is provided on the bottom side of the cleaner body 10.

The cyclone unit 20 comprises a cyclone body 30 and a soil collection receptacle 40 detachably connected to the cyclone body 30.

The upper side of the cyclone body 30 is provided with an inflow passage 31 communicating with the suction brush 12, whereby soils inhaled through the suction brush 12 from a to-be-cleaned-surface flow into the inside of the cyclone body 30 through the inflow passage 31. Here, the inflow passage 31 is arranged so that the air inhaled through the inflow passage 31 flows into the cyclone body 30 in the tangential direction of the cyclone body 30. Therefore, the air inhaled through the inflow passage 31 forms swirling streams along the inner wall of the cyclone body 30.

A discharge passage 32 communicating with the vacuum-generating device is provided at the center of the topside of the cyclone body 30. Soils-removed air is discharged from the cyclone body 30 to the outside of the cleaner body 10 through the discharge passage 32 and the vacuum-generating device. And, the soils separated from the air in the cyclone body 30 are collected in the soil collection receptacle 40 connected to the bottom side of the cyclone body 30.

By the way, the cyclone accommodation recess 11 are arranged of the cleaner body 10 in such a manner that one end of each of the tubes 13 and 14 opens toward the front, wherein the other ends of the tubes 13 and 14 are connected to the vacuum generating device and the suction brush 12, respectively, and the inflow passage 31 and the discharge passage 32 are arranged in parallel toward the rear. Accordingly, the only horizontal movement of the cyclone body 30 allows easy connection of the inflow passage 31 and the discharge passage 32 with the tubes 13 and 14.

A locking handle 33 is rotatably installed in the rear part of the outside of the cyclone body 30 and the corresponding part in the cleaner body 10 is provided with a handle receiving part 15. If the locking handle 33 is rotated 90° after passing through the handle receiving part 15, the cyclone body 30 is installed in the cleaner body 10.

However, the above-mentioned conventional cyclone vacuum cleaner has a problem in that in order to dump soils collected in the soil collection receptacle 40, it is required to entirely separate the cyclone unit 20 from the accommodation recess 11 of the cleaner body 10 and then to separate the soil collection receptacle 40 from the cyclone body 30, thereby causing inconvenience in use.

That is, with the conventional cyclone vacuum cleaner, it impossible to separate only the soil collection receptacle 40 from the cyclone accommodation recess 11 of the cleaner body 10 due to the construction thereof. Accordingly, it is requested that the locking apparatus of the cyclone body 30 be firstly released in relation to the cleaner body 10, the cyclone unit 20 be entirely separated from the cleaner body, and then the soil collection receptacle 40 be separated from the cyclone body 30. The cyclone unit 20 should be mounted in the cleaner body in the reversed order after the soils collected in the soil collection receptacle are dumped. Therefore, there is a disadvantage in that the above handling is very complicate and it is very difficult to disassemble and assemble the soil collection receptacle 40.

In addition, such a conventional vacuum cleaner exhibits a sanitary problem in that the user's hands or clothes are stained with collected dusts when the soil collection receptacle is periodically disassembled, cleaned and assembled.

SUMMARY

Accordingly, the present invention has been made to solve the above-mentioned problems occurring in the prior art, and an object of the present invention is to provide a soil collection receptacle attaching/detaching apparatus that enables attachment/detachment of only the soil collection receptacle in the state in which a cyclone unit is secured in a cleaner body, whereby the soils collected in the soil collection receptacle can be conveniently dumped.

Another object of the present invention is to provide a cyclone vacuum cleaner provided with a soil collection receptacle attaching/detaching apparatus having the above-mentioned feature, whereby the convenience in use can be greatly enhanced.

Yet another object of the present invention is to provide a soil collection receptacle attaching/detaching apparatus for a vacuum cleaner, which prevents a user's hands, clothes, etc. from being stained with dusts or soils when the soil collection receptacle is disassembled or assembled, and which allows disassembling and assembling of the soil collection receptacle to be conveniently and sanitarily disassembled or assembled, and to provide a vacuum cleaner provided with the soil collection receptacle attaching/detaching apparatus.

In order to achieve the above objects, according to the present invention, there is provided a soil collection receptacle attaching/detaching apparatus for a cyclone vacuum cleaner, which allows only a soil collection receptacle to be attached to or detached from a cyclone unit that includes a cyclone body as well as the soil collection receptacle, in which the cyclone unit is installed in an accommodation recess provided in a cleaner body, the soil collection receptacle attaching/detaching apparatus comprising: a guide member located at the lower end of the soil collection receptacle and having guide projections respectively formed at the opposite sides thereof; and an operation lever adapted to move the guide member up and down and provided with a manipulation part and a pair of guide holes that cooperate with the guide projections, wherein the guide member moves up and down as the manipulation part is pulled and pushed, whereby the soil collection receptacle is attached to or detached from the cyclone unit.

It is preferable that the soil collection receptacle has a sliding groove formed on the bottom surface that confronts the floor of the accommodation recess.

It is also preferable that the sliding groove is formed on the bottom surface to face the rear part of the inside of the accommodation recess and to have predetermined depth and width.

The floor of the accommodation recess in the cleaner body is preferably provided with a guide supporting part for supporting and guiding the guide member, and the soil collection receptacle is preferably provided with a handle.

In order to achieve the above objects, according to the second aspect of the present invention, there is also provided a cyclone vacuum cleaner comprising: a cleaner body provided with a suction brush at the bottom side thereof, wherein a vacuum generating device is housed in the cleaner body; a cyclone body installed in an accommodation recess provided in the cleaner body, wherein the cyclone body separates soils from air inhaled through an inflow passage communicating with the suction brush and discharges purified air through a discharge passage communicating with the vacuum generating device; a soil collection receptacle for collecting soils separated by the cyclone body, wherein the soil collection receptacle is removably engaged with the bottom side of the cyclone body; and a soil collection receptacle attaching/detaching apparatus that allows only the soil collection receptacle to be independently attached to or detached from the accommodation recess regardless of the cyclone body, wherein the soil collection receptacle attaching/detaching apparatus comprises: a guide member located at the lower end of the soil collection receptacle and formed with a pair of guide projections at the opposite sides; and an operation lever adapted to move the guide member up and down and provided with a manipulation part and a pair of guide holes that cooperate with the guide projections, wherein the guide member moves up and down as the manipulation part is pulled and pushed, whereby the soil collection receptacle is attached to or detached from the cyclone unit.

It is preferable that the soil collection receptacle has a sliding groove formed on the bottom surface that confronts the floor of the accommodation recess.

It is also preferable that the sliding groove is formed on the bottom surface to face the rear part of the inside of the accommodation recess and to have predetermined depth and width.

The floor of the accommodation recess in the cleaner body is preferably provided with a guide supporting part for supporting and guiding the guide member, and the soil collection receptacle is preferably provided with a handle.

The cyclone body may have a locking handle at the rear side thereof, wherein the locking handle is inserted and fixed in a handle receiving part formed in the inner surface of the accommodation recess in the cleaner body, whereby the cyclone body is installed in the accommodation recess.

BRIEF DESCRIPTION OF THE DRAWINGS

The above and other objects, features and advantages of the present invention will be more apparent from the following detailed description taken with reference to the accompanying drawings, in which.

DETAILED DESCRIPTION OF THE PREFERRED EMBODIMENTS

Hereinbelow, the preferred embodiments will be described in more detail with reference to the accompanying drawings.

Figure 1:
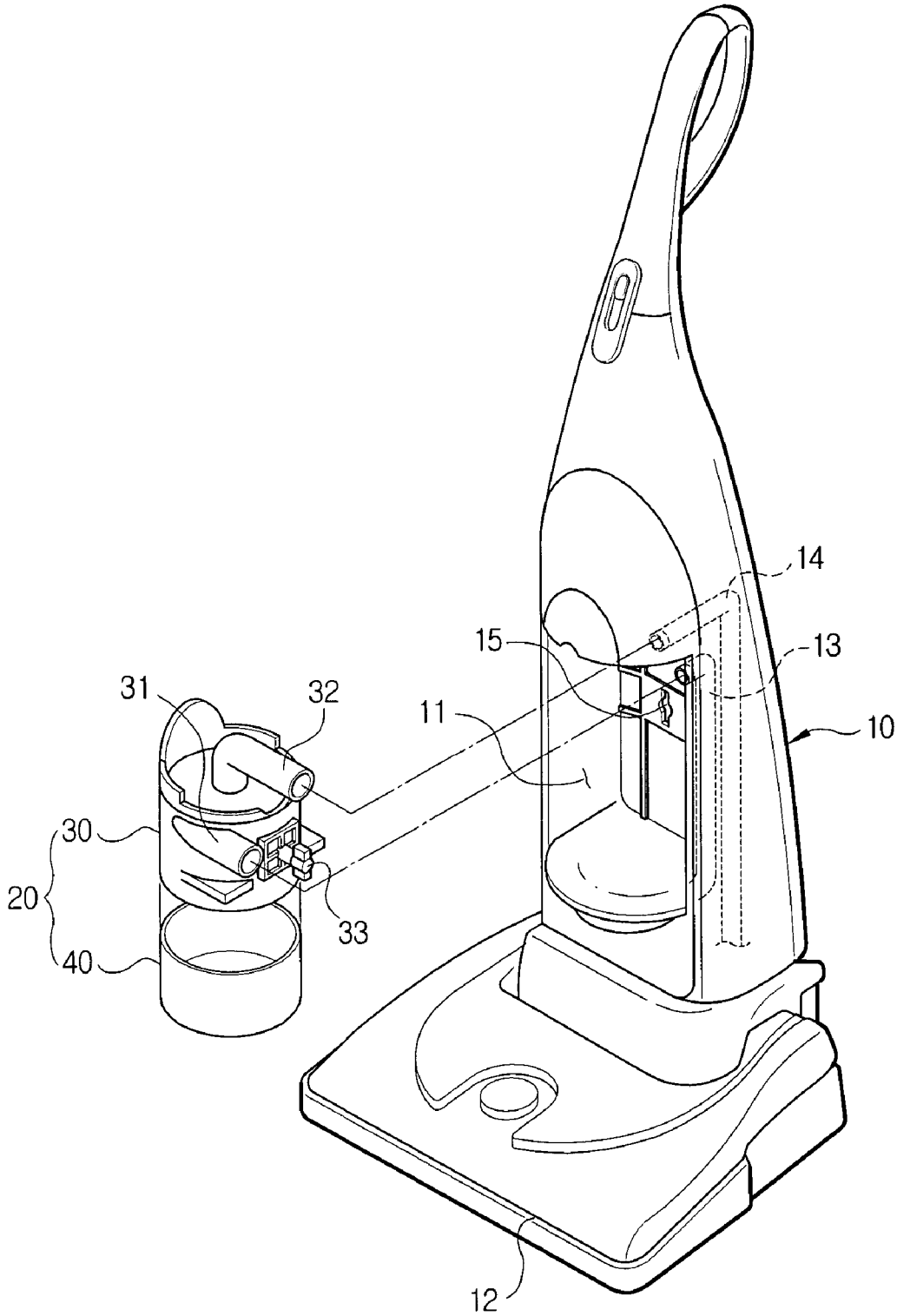
FIG. 1 (PRIOR ART)
FIG. 1 is a perspective view showing the state in which a conventional cyclone unit is separated from a cyclone vacuum cleaner.
Figure 2:
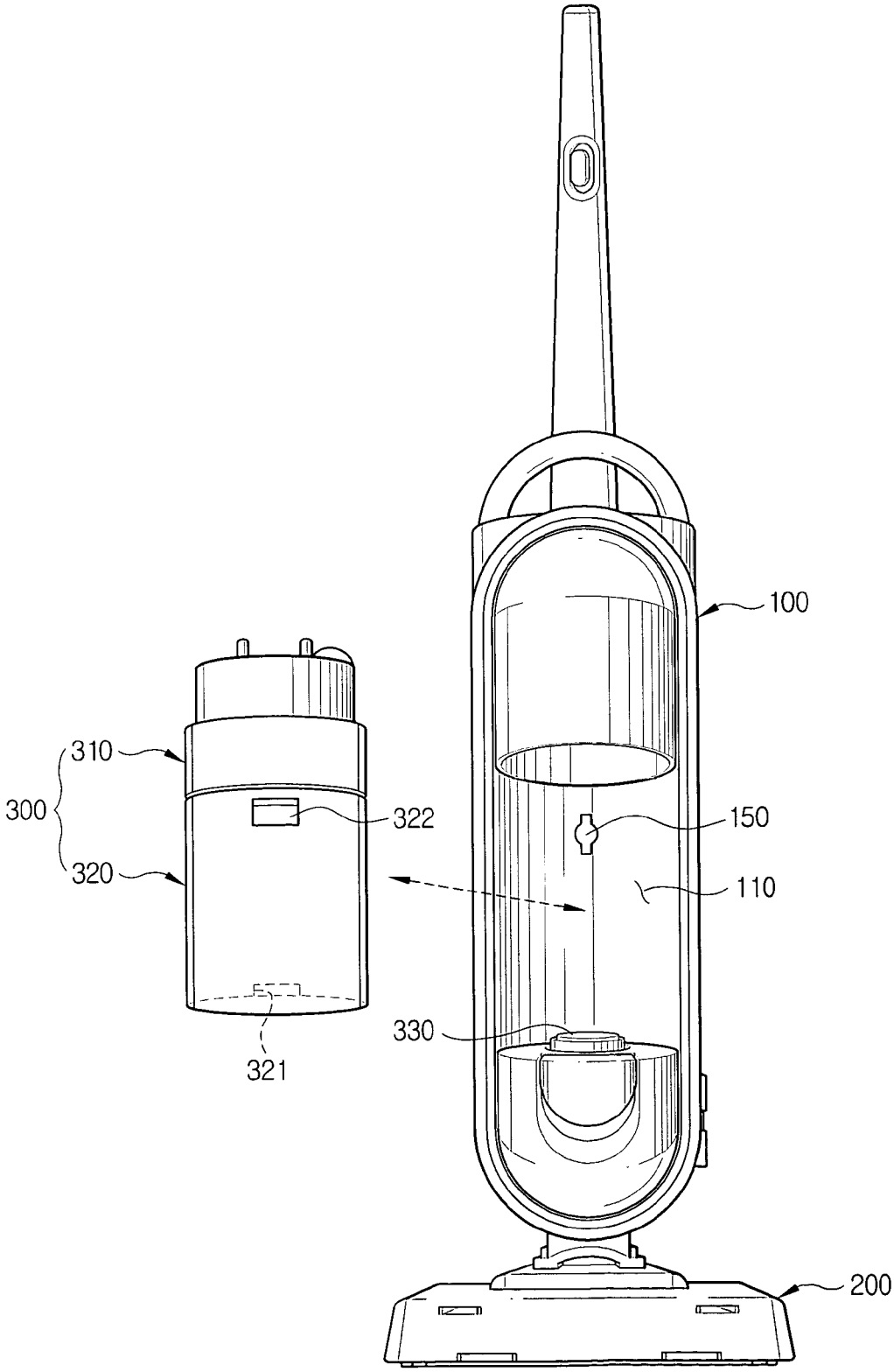
FIG. 2 is a perspective view showing the state in which a cyclone unit employing a soil collection receptacle attaching/detaching apparatus according to present invention is separated from a cyclone vacuum cleaner.
Figure 3:
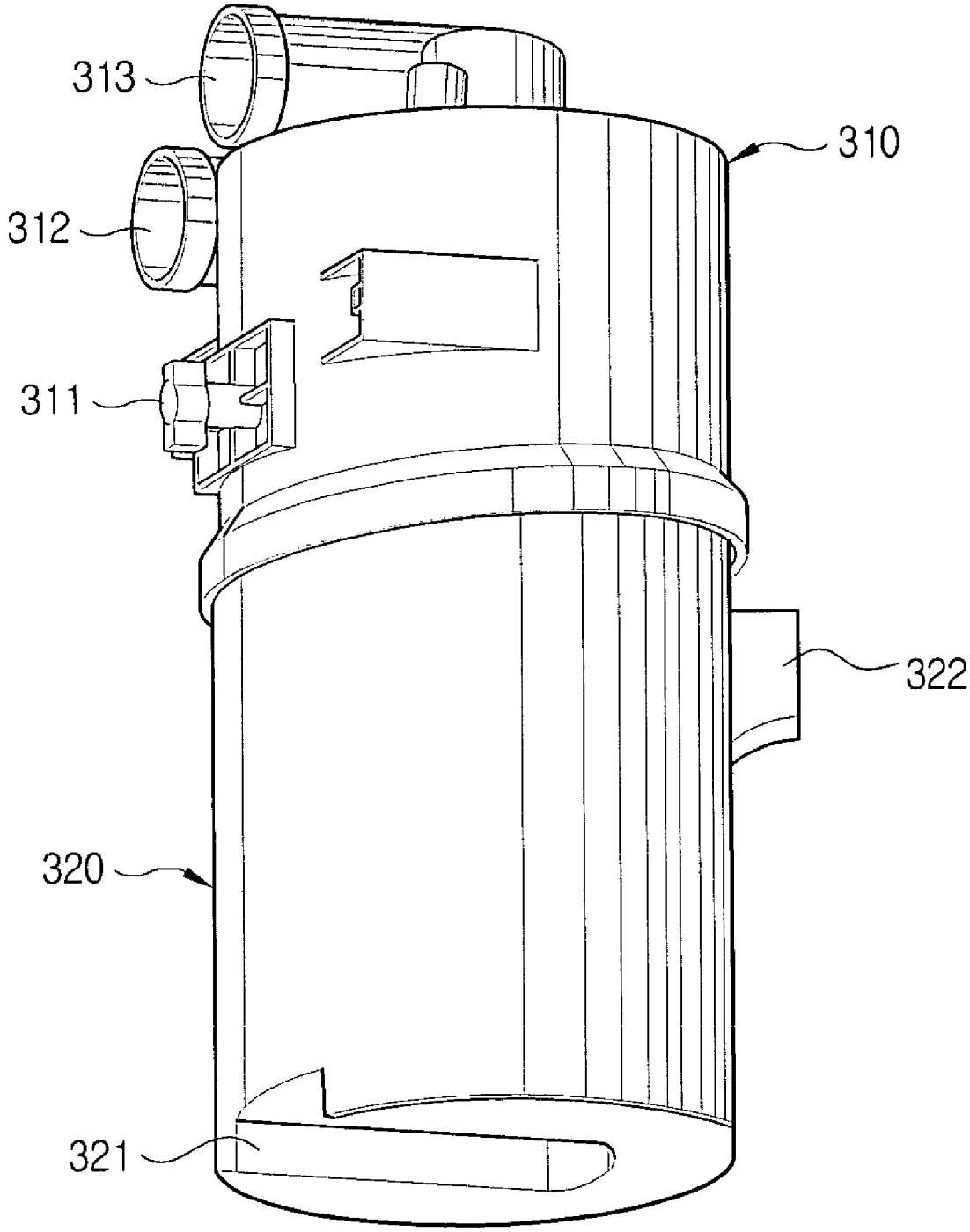
FIG. 3 is a perspective view showing the cyclone unit according to the present invention viewed from the lower side thereof.
Figure 4:
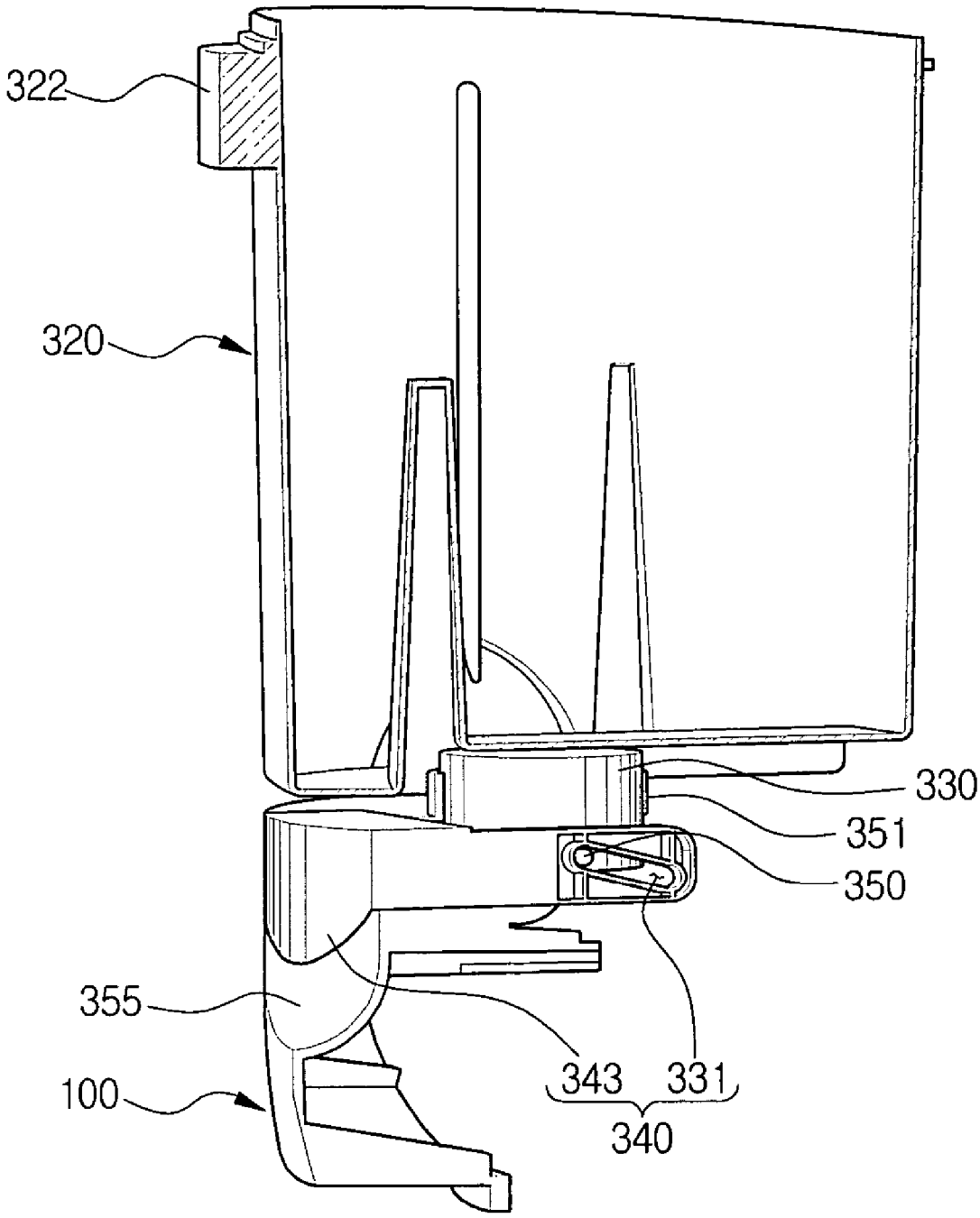
FIG. 4 is a cross-sectional view of the main part of the soil collection receptacle attaching/detaching apparatus according to the present invention.

FIG. 2 is a perspective view showing the state in which a cyclone unit employing a soil collection receptacle attaching/detaching apparatus according to present invention is separated from a cyclone vacuum cleaner; FIG. 3 is a perspective view showing the cyclone unit according to the present invention from the lower side thereof; and FIG. 4 is a cross-sectional view of the main part of the soil collection receptacle attaching/detaching apparatus according to the present invention.

In FIG. 2, reference numeral 100 indicates a cleaner body, reference numeral 200 indicates a suction brush, and reference numeral 300 indicates a cyclone unit.

The cleaner body 100 is provided with an accommodation recess 110, within which the cyclone unit 300 is installed. In addition, a vacuum-generating device (not shown) is mounted in the inside of the cleaner body 100 and the suction brush 200 is provided on the bottom side of the cleaner body 100.

The cyclone unit 300 comprises a cyclone body 310 and a soil collection receptacle 320. As shown in FIG. 3, the cyclone body 310 is firmly installed within the accommodation recess 100 by fixing a locking handle 311 provided in the rear part of the cyclone body 310 to a handle receiving part 150 formed in the inside surface of the accommodation recess 110 of the cleaner body 100. And, the soil collection receptacle 320 is removably attached on the bottom side of the cyclone body 310.

In addition, on the top side of the cyclone body 310, there is provided an inflow passage 312 communicating with the suction brush 200, whereby soils inhaled from a to-be-cleaned-surface through the suction brush 200 flow into the inside of the cyclone body 310 through the inflow passage 312. Here, the inflow passage 312 is arranged such that air inhaled through the inflow passage 312 flows into the cyclone body 310 in the tangential direction, whereby the air inhaled through the inflow passage 312 forms whirling air streams along the inside wall of the cyclone body 310.

A discharge passage 313 is also provided at the center of the topside of the cyclone body 310, in fluid communication with the vacuum-generating device. The air, from which soils have been removed within the cyclone body 310, is discharged to the outside of the cleaner body 100 through the discharge passage 313 and the vacuum generating device, and the soils separated from the air in the cyclone body 310 descend and accumulate in the soil collection receptacle 320.

The soil collection receptacle 320 comprises a sliding groove 321 formed on the bottom surface that confronts the floor of the accommodation recess 110 formed in the cleaner body 100. The sliding groove 321 is formed on the bottom surface of the soil collection receptacle 320 to open toward the rear, and the sliding groove may have predetermined depth and width. In addition, a handle 332 is formed in the front surface of the soil collection receptacle 320 for handling the soil collection receptacle 320.

When the soil collection receptacle 320 is full of soils, the soil collection receptacle 320 is separated from the cleaner body 100 and the soils are dumped, wherein the soil collection receptacle 320 can be independently attached to/detached from the accommodation recess 110 in the cleaner body 100 regardless of the cyclone body 310.

The soil collection receptacle attaching/detaching apparatus for allowing the independent attaching/detaching of the soil collection receptacle 320 comprises a guide member 330 and an operation lever 340 as shown in FIGS. 2 to 4.

The guide member 330 is located at the lower end of the soil collection receptacle 320 and having guide projections 350 respectively provided at the opposite sides thereof. In addition, the floor of the accommodation recess 110 in the cleaner body 100 is formed with a guide supporting part 351 for supporting the guide member 330.

The operation lever 340 is positioned in a side of the front of the floor of the accommodation recess 110 in the cleaner body 100, and the operation lever 340 is provided with a manipulation part 343 and guide holes 331 that cooperate with the guide projections 350 to move the guide member 330 up and down.

The manipulation part 343 is positioned at a side of the front of the operation lever 340, and the manipulation part 343 is formed in a semicircular shape such that a user can conveniently push and pull the operation lever. The shape of the manipulation part may be formed in various shapes such that the user can conveniently grip it.

In addition, the lower part of the front of the cleaner body 100 is formed with a semicircular recess 355 at a portion where the manipulation part 343 comes into contact when the manipulation part 343 is pushed or pulled, wherein the semicircular recess 355 allows the user to easily grip the manipulation part.

The guide holes 331 are formed to be inclined in the rear part of the operation lever 340. Each guide hole may be either straight or somewhat curved and the front part is higher than the rear part.

In addition, the guide holes 331 receive the guide projections 350 of the guide member 330 and the guide member 330 moves up and down as the manipulation part 343 is pushed and pulled.

For example, by pushing and pulling the operation lever 340 as mentioned above, the operation lever 340 moves before and behind in proportion to the given horizontal interval from the front end to the rear end of the guide holes 331.

That is, as the operation lever 340 moves before and behind, the guide projections 350 respectively received in the guide holes 331 move up and down, whereby the guide member 330 moves up and down within a predetermined range of height. Further, as the guide member 330 moves up and down, it becomes possible to independently separate the soil collection receptacle 320 regardless of the cyclone body 310. This operation is described below with reference to FIGS. 4, 5A and 5B.

Figure 5A:
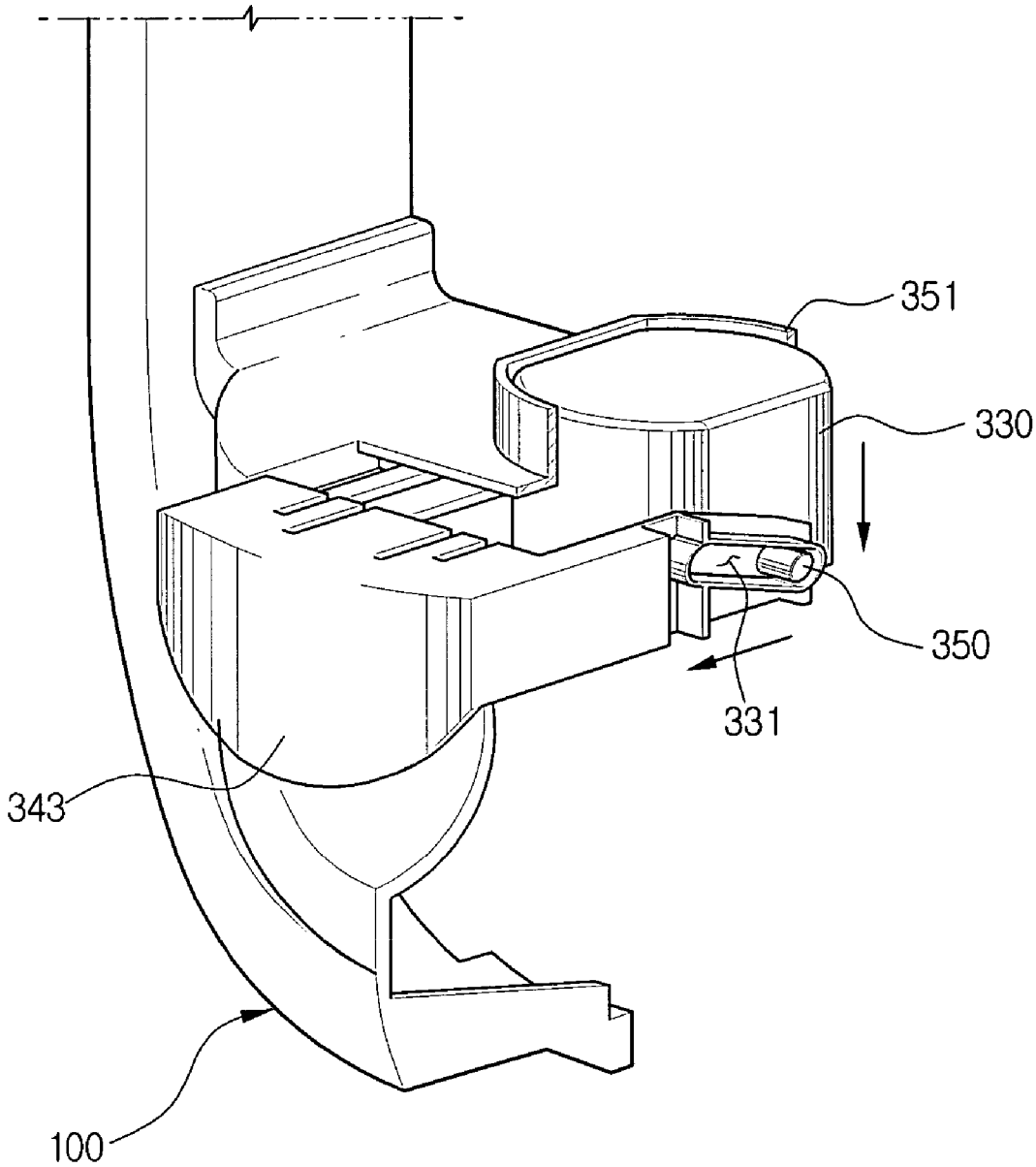
FIG. 5A is a partial cut-away perspective view of the main part of the soil collection receptacle attaching/detaching apparatus according to the present invention, in which the guide member is shown as being moved downwardly when the operation lever is pulled.

FIG. 5A is a partial cut-away perspective view of the main part of the soil collection receptacle attaching/detaching apparatus according to the present invention, in which the guide member 330 is shown as being moved downwardly when the operation lever is pulled.

In this event, the guide projections 340 received in the guide holes 331 move down along the guide holes 331 and the guide member 330 including the guide projections 330 are lowered by a predetermined range of height, and thus the soil collection receptacle 320 with the sliding groove 321 slidably engaged with the guide member 330 is also lowered, whereby the soil collection receptacle 320 will be spaced from the cyclone body 310. In this state, if the handle 322 of the soil collection receptacle 320 is gripped and pulled ahead, only the soil collection receptacle 320 will be separated from the accommodation recess 110 in the cleaner body 100.

Figure 5B:
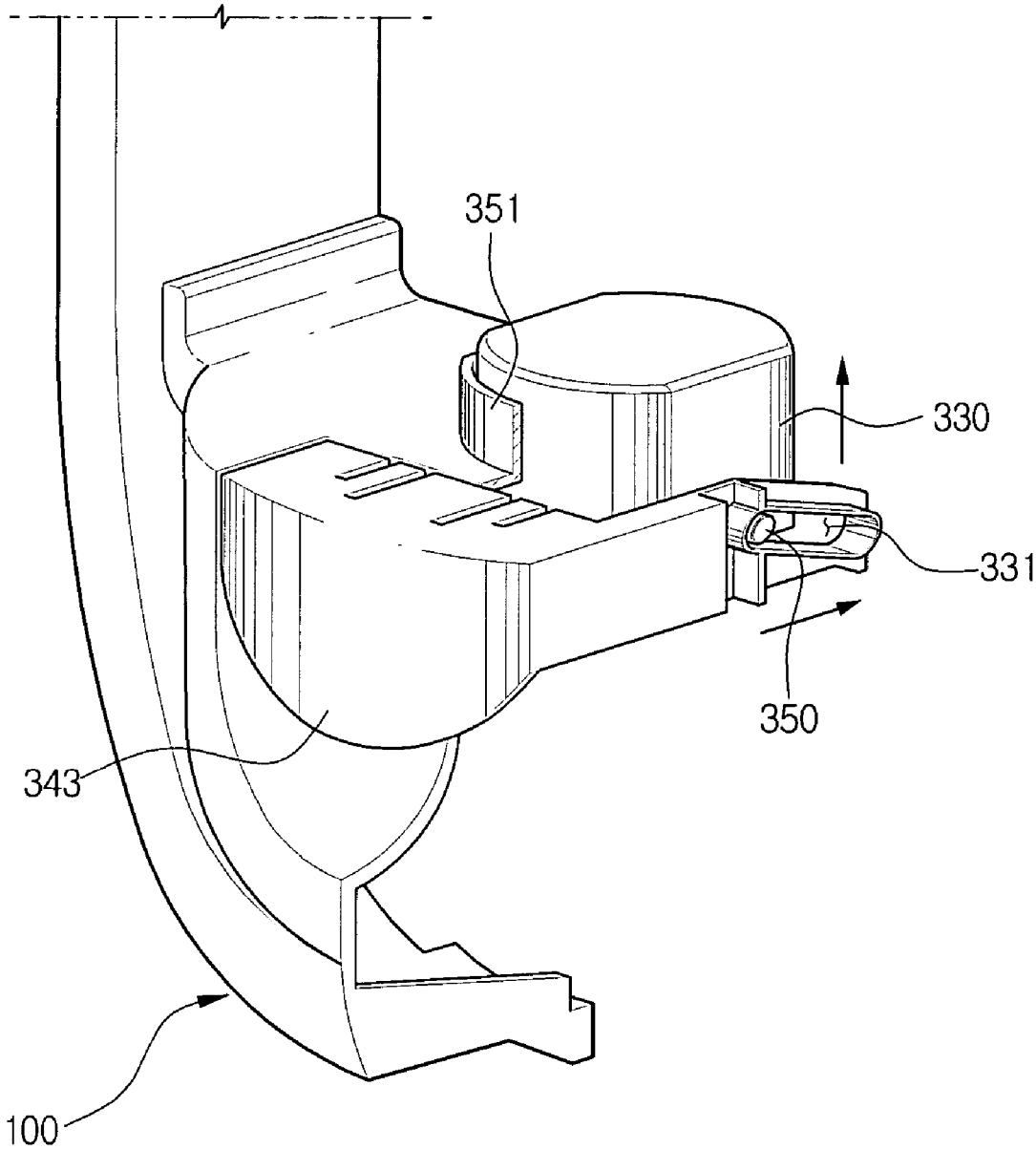
FIG. 5B is a partial cut-away perspective view of the main part of the soil collection receptacle attaching/detaching apparatus according to the present invention, in which the guide member is shown as being moved upwardly when the operation lever is pushed.

After the soils in the soil collection receptacle 320 are dumped, if the operation lever 340 is pushed into the cleaner body 100 in the state where the soil collection receptacle 320 is positioned as shown in FIG. 5A, the guide projections 350 of the guide member 330 move up along the guide holes 331 and thus the guide member 330 is lifted to a predetermined height, whereby the soil collection receptacle 320 is engaged with the cyclone body 310 while being lifted (see FIG. 5B).

The above-mentioned attaching/detaching apparatus of the cyclone vacuum cleaner 100 as an example of the present invention can be variantly embodied in various forms by an ordinary skilled person in the art, only if the guide projections 350 received in the guide holes 331 of the operation lever 340 and hence the guide member 330 are capable of being moved up and down when the operation lever 340 is pushed into or pulled out of the cleaner body. Therefore, the guide projections 350 may be formed on the operation lever 340 while the guide holes 331 may be formed in the guide member 330.

Like this, the soil collection receptacle attaching/detaching apparatus for a cyclone vacuum cleaner according to the present invention allows only the soil collection receptacle 320 to be separated from or engaged with the cyclone body by simply manipulating the lever 340. Accordingly, it becomes possible to separate the soil collection receptacle 320 from or to install the soil collection receptacle 320 into the accommodation recess 110 in the cleaner body 100 regardless of the cyclone body 310, whereby the soils collected in the soil collection receptacle 320 can be more conveniently dumped.

As described above, according to the present invention, it is possible to independently separate the soil collection receptacle from or mount the soil collection into the cyclone unit mounted in an accommodation recess in the cleaner body regardless of the cyclone body. Therefore, when it is desired to dump the soils collected in the soil collection receptacle, only the soil collection receptacle only can be separated to conveniently dump the soil, and then the soil collection receptacle can be mounted again and used.

That is, the cyclone vacuum cleaner can be greatly enhanced in connection with the convenience in use, the assembling and disassembling of the soil collection receptacle of the cleaner can be more easily performed, and a user's hands or clothes can be prevented from being stained with dusts or soils. Therefore, it is possible to provide a very satisfactory product in view of the user's preference, whereby the competitiveness of the product can be further strengthened.

While the preferred embodiments of the present invention has been shown and described with reference to the preferred embodiments thereof, the present invention is not limited to the embodiments. It will be understood that various modifications and changes can be made by those skilled in the art without departing from the spirit and scope of the invention as defined by the appended claims. It should be considered that such modifications, changes and equivalents thereof are all included within the scope of the present invention.

What is claimed is:

1. A soil collection receptacle attaching/detaching apparatus for a cyclone vacuum cleaner, which allows only a soil collection receptacle to be attached to or detached from a cyclone unit that includes a cyclone body as well as the soil collection receptacle, in which the cyclone unit is installed in an accommodation recess provided in a cleaner body, the soil collection receptacle attaching/detaching apparatus comprising:

a guide member located at a part of the accommodation recess where the soil collection receptacle is installed, and comprising guide projections formed on opposite sides; and an operation lever provided with a manipulation part and guide holes that cooperate with the guide projections, wherein if the manipulation part is pushed to the cleaner body in the state where the soil collection receptacle is installed in the accommodation recess, the guide projections move up along the guide holes and thus the guide member is lifted, whereby the soil collection receptacle is lifted and engaged with the cyclone body, and if the manipulation part is pushed outside the cleaner body in the state where the soil collection receptacle is engaged with the cyclone body, the guide projections move down along the guide holes and thus the guide member is lowered, whereby the soil collection receptacle is separated from the cyclone body.

2. The apparatus according to claim 1, wherein the soil collection receptacle has a sliding groove formed on the bottom surface that confronts the floor of the accommodation recess.

3. The apparatus according to claim 2, wherein the sliding groove is formed on the bottom surface of the soil receptacle and extends from a rear side of the soil collection receptacle in a direction along which the soil collection receptacle is inserted in the accommodation recess.

4. The apparatus according to claim 1, wherein the floor of the accommodation recess in the cleaner body is provided with a guide supporting part for supporting and guiding the guide member.

5. The apparatus according to claim 1, wherein the soil collection receptacle is provided with a handle.

6. A cyclone vacuum cleaner comprising:

a cleaner body provided with a suction brush at the bottom side thereof, wherein a vacuum-generating device is housed in the cleaner body;

a cyclone body installed in an accommodation recess provided in the cleaner body, wherein the cyclone body separates soils from air inhaled through an inflow passage communicating with the suction brush and discharges purified air through a discharge passage communicating with the vacuum generating device;

a soil collection receptacle for collecting soils separated by the cyclone body, wherein the soil collection receptacle is removably engaged with the bottom side of the cyclone body; and a soil collection receptacle attaching/detaching apparatus that allows only the soil collection receptacle to be independently attached to or detached from the accommodation recess regardless of the cyclone body, wherein the soil collection receptacle attaching/detaching apparatus comprises:

a guide member located at a part of the accommodation recess where the soil collection receptacle is installed, and comprising guide projections formed on opposite sides; and an operation lever provided with a manipulation part and guide holes that cooperate with the guide projections, wherein if the manipulation part is pushed to the cleaner body in the state where the soil collection receptacle is installed in the accommodation recess, the guide projections move up along the guide holes and thus the guide member is lifted, whereby the soil collection receptacle is lifted and engaged with the cyclone body, and if the manipulation part is pushed outside the cleaner body in the state where the soil collection receptacle is engaged with the cyclone body, the guide projections move down along the guide holes and thus the guide member is lowered, whereby the soil collection receptacle is separated from the cyclone body.

7. The cyclone vacuum cleaner according to claim 6, wherein the soil collection receptacle has a sliding groove formed on the bottom surface that confronts the floor of the accommodation recess.

8. The cyclone vacuum cleaner according to claim 7, wherein the sliding groove is formed on the bottom surface to face the rear part of the inside of the accommodation recess.

9. The cyclone vacuum cleaner according to claim 6, wherein the floor of the accommodation recess in the cleaner body is provided with a guide supporting part for supporting and guiding the guide member.

10. The cyclone vacuum cleaner according to claim 6, wherein the soil collection receptacle is provided with a handle.

11. The cyclone vacuum cleaner according to claim 6, wherein the cyclone body has a locking handle at the rear side thereof, wherein the locking handle is inserted and fixed in a handle receiving part formed in the inner surface of the accommodation recess in the cleaner body, whereby the cyclone body is installed in the accommodation recess.

* * * * *